US005967439A

United States Patent [19]

Klein

[11] Patent Number: 5,967,439

[45] Date of Patent: Oct. 19, 1999

[54] WIRE COIL FORMING STATION

[75] Inventor: Dieter Klein, Siegen, Germany

[73] Assignee: SMS Schloemann-Siemag Aktiengesellschaft, Düsseldorf, Germany

[21] Appl. No.: 09/016,624

[22] Filed: Jan. 30, 1998

[30] Foreign Application Priority Data

Feb. 6, 1997 [DE] Germany ..... 197 04 423

[51] Int. Cl.[6] ..... B21C 47/24

[52] U.S. Cl. ..... 242/363

[58] Field of Search ..... 242/360, 361.1, 242/361.2, 361.3, 361, 361.4, 362, 362.1, 362.2, 362.3, 363, 533, 559.2

[56] References Cited

FOREIGN PATENT DOCUMENTS 3109110 3/1984 Germany .
3525089 9/1995 Germany .

*Primary Examiner*—Donald P. Walsh
*Assistant Examiner*—William A. Rivera
*Attorney, Agent, or Firm*—Friedrich Kueffner

[57] ABSTRACT

A wire coil forming station to be arranged following a coiler with cooling line includes a rotatable shaft extending with an inclination of 45° relative to a horizontal base and mandrels mounted at equal circumferential distances and at an angle of 45° relative to the shaft axis on the free end of the shaft. The shaft is rotatable for moving each mandrel successively into an approximately vertical coil forming position and into an approximately horizontal position in which the transfer of a coil to a longitudinally moveable and raisable and lowerable hook of a hook-type conveyor takes place. Each mandrel is composed of a U-shaped section which is open toward the shaft axis. The free end of each mandrel has a support for a cap to be placed on the support, wherein, seen in the axial projection, the diameter of the body of the cap determining the wire coil diameter protrudes with a radial distance to all sides beyond the approximately square cross-section of the mandrel. The section of each mandrel is selected in such a way that lifting of a coil from the mandrel by a hook of a hook-type conveyor takes place without further contact of the rolling stock with the mandrel.

11 Claims, 3 Drawing Sheets

WIRE COIL FORMING STATION

BACKGROUND OF THE INVENTION

1. Field of the Invention

The present invention relates to a wire coil forming station to be arranged following a coiler with cooling line. The wire coil forming station includes a rotatable shaft extending with an inclination of 45° relative to a horizontal base and mandrels mounted at equal circumferential distances and at an angle of 45° relative to the shaft axis on the free end of the shaft. The shaft is rotatable for moving each mandrel successively into an approximately vertical coil forming position and into an approximately horizontal position in which the transfer of a coil to a longitudinally moveable and raisable and lowerable hook of a hook-type conveyor takes place.

2. Description of the Related Art

Various types of constructions of wire coil forming stations following a coiler with cooling line are known in the art. DE 35 25 089 C2 discloses a wire coil forming station following a coiler with cooling line which includes several receiving mandrels which are arranged at the end of a shaft in equal angular distances from each other and at equal angles relative to the axis of the shaft, wherein the mandrels can be pivoted by rotating the shaft successively into an approximately vertical coil forming position and into an approximately coil transfer position, wherein segments of the receiving mandrels can be moved in such a way that the circumference of the receiving mandrels changes.

This change in circumference is achieved by coupling the segments through a mechanical forced control to the shaft, so that the segments are moved during the rotation of the shaft in such a way that the circumference of the receiving mandrel changes.

This configuration requires a kinematic construction of the segments with a plurality of joint arrangements which are highly susceptible to trouble because the coil forming station produces large quantities of scale, dust and metal abrasion, so that the unit requires a lot of maintenance work and occasional interruptions in the operation of the unit occur because of failures.

DE 31 09 110 C2 discloses a device for forming rolled wire coils of a different operational and structural type. This device includes a vertical drop chute with two intermediate floors moveable in the chute, at least one cutting device arranged below and outside of the drop chute and moveable into a position for cutting a wire winding hanging from an intermediate floor, and a coil forming chamber located below the drop chute, wherein the coil forming chamber is provided with at least two coil plates with raisable and lowerable mandrels, wherein the coil plates are raisable and lowerable within the coil forming chamber. In this device, the invention resides in that the coil plates and the mandrels are arranged with their lifting drives on a carriage moveable underneath the coil forming chamber and that a two-part table plate fixedly arranged in the area of the coil forming chamber is provided between the coil forming chamber and the lowermost position of the coil plates.

For transferring the formed coils to a transport device for further conveyance, an upender of conventional construction is provided following the coil forming chamber as seen in rolling direction, but on the same level as the coil forming station, wherein the distance between the center of the upender and the center of the coil forming chamber corresponds to the distance between the two mandrels.

SUMMARY OF THE INVENTION

Therefore, starting from the prior art discussed above, it is the primary object of the present invention to further develop and improve a wire coil forming station of the above-described type and particularly to decisively simplify the operational construction of the mandrels by using the mandrels only for the purpose of receiving the wire coil during the coil formation in vertical position and, subsequently to the coil formation, to move the wire coil by a pivoting movement from the vertical position into a horizontal position. Moreover, the mandrels have the purpose of supporting the cap of the coil forming chamber during the collecting process.

In accordance with the present invention, each mandrel is composed of a U-shaped section which is open toward the shaft axis. The free end of each mandrel has a support for a cap to be placed on the support, wherein, seen in the axial projection, the diameter of the body of the cap determining the wire coil diameter protrudes with a radial distance to all sides beyond the approximately square cross-section of the mandrel. The section of each mandrel is selected in such a way that lifting of a coil from the mandrel by means of a hook of a hook-type conveyor takes place without further contact of the rolling stock with the mandrel.

The configuration according to the present invention provides the advantage that the transfer of a wire coil collected on a mandrel in the vertical position of the mandrel to the hook of a hook-type conveyor is significantly simplified because, after pivoting of the mandrel into the horizontal transfer position, the hook can be freely moved into the open end of the mandrel and can raise the coil to such an extent that it is no longer in contact with the mandrel. This is possible because of the construction of the mandrel as an open U-shaped section and the formation of the wire coil by the cap with a radial distance to all sides relative to the cross-section of the mandrel.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
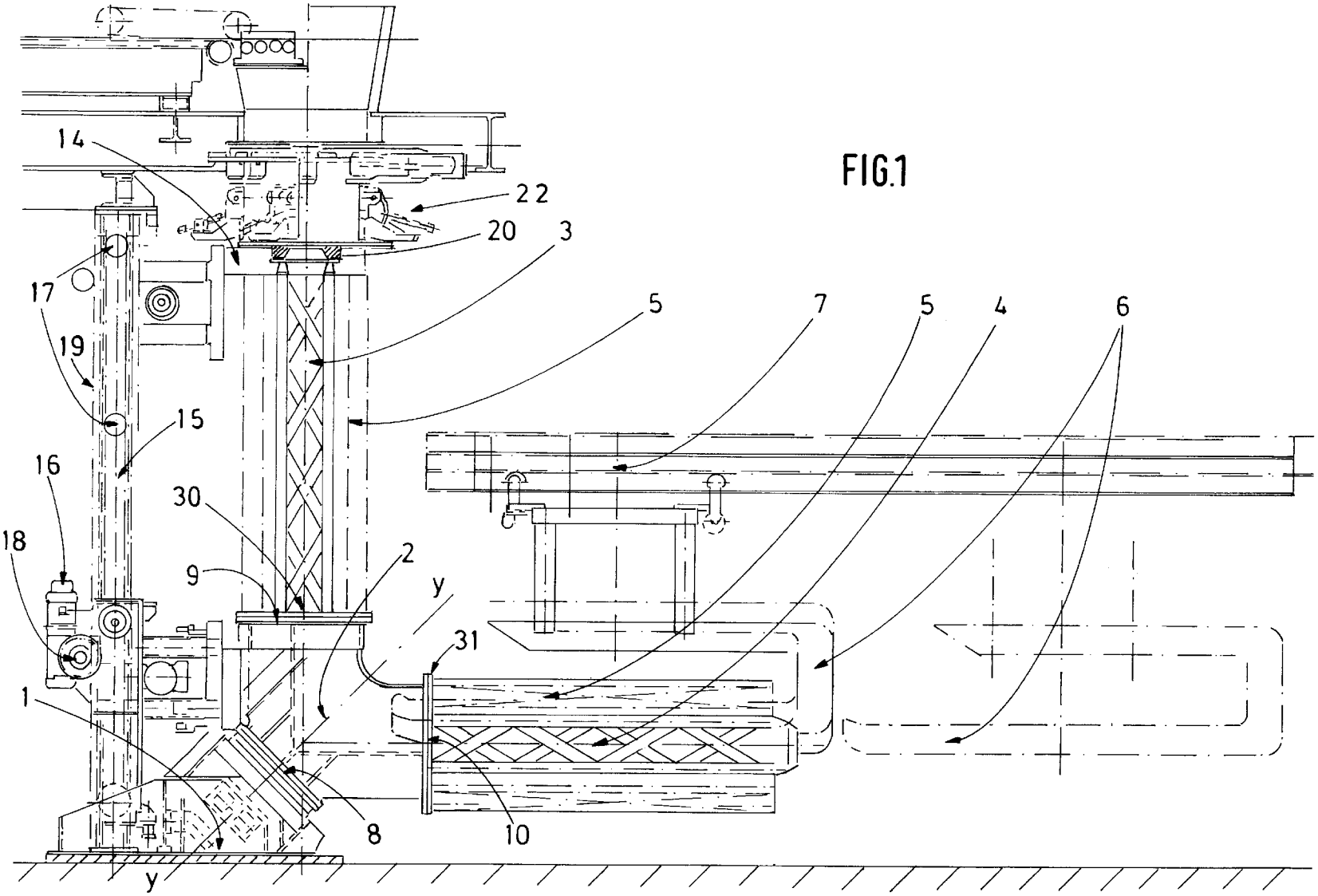
FIG. 1 is a schematic side view of a coil forming station.

FIG. 1 shows a wire coil forming station according to the present invention arranged following a coiler with cooling line. The coil forming station includes a rotatable shaft 2 which is inclined at an angle of 45° relative to a horizontal base 1. Two mandrels 3, 4 are mounted in different positions on the free end of the shaft 2 at equal circumferential distances and at an angle of 45° relative to the shaft axis y-y.

By rotating the shaft 2, the mandrels 3, 4 can be moved successively into an approximately vertical coil forming position 3 and into an approximately horizontal position 4. In this horizontal position 4, the coil 5 is transferred to a longitudinally moveable and raisable and lowerable hook 6 of a hook-type conveyor 7.

Figure 4:
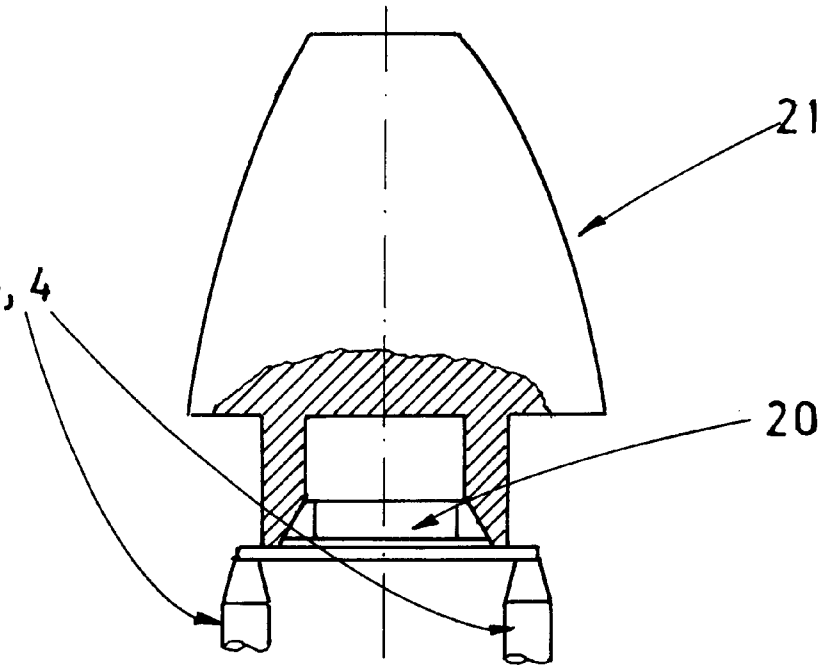
FIG. 4 is a side view, partially in section, of the free end of a vertically extending mandrel with a cap placed on the mandrel.
Figure 3:
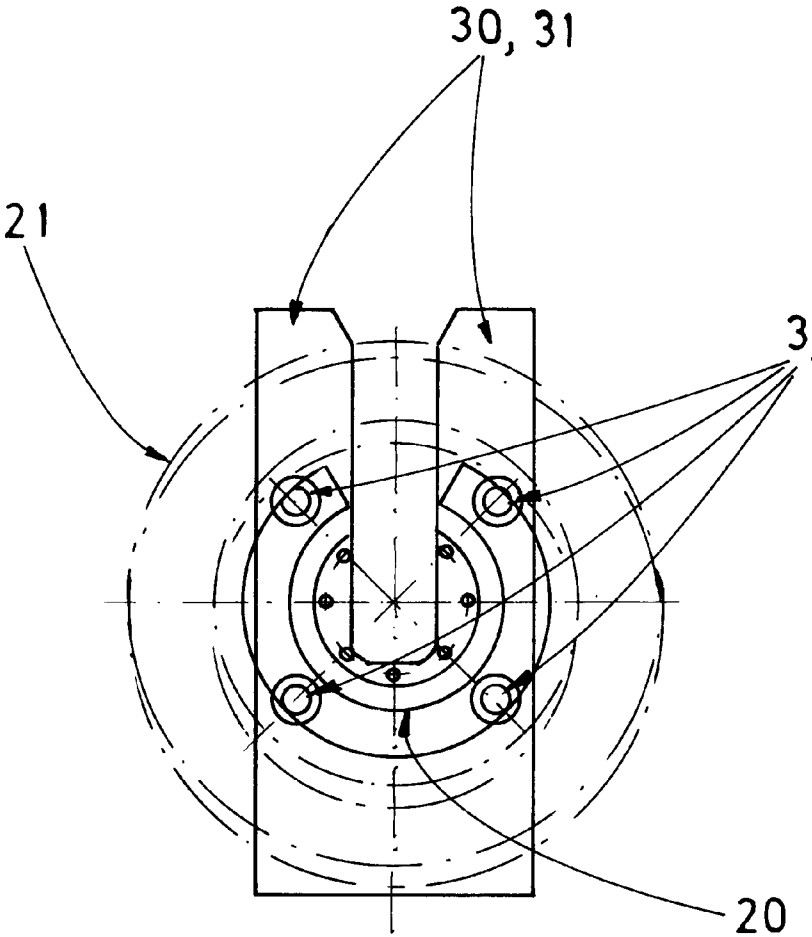
FIG. 3 is an axial projection of a coil receiving mandrel.

In accordance with the present invention, each mandrel 3, 4 is a U-shaped section which is open toward the shaft axis y-y. At its free end, each mandrel 3, 4 has a support 20 for a cap 21 to be placed on the mandrel, as shown in FIGS. 3, 4. The diameter of the body of the cap 21 determines the internal diameter of the wire coil 5, wherein, seen in the axial projection, the diameter of the body protrudes to all sides with a radial distance beyond the approximately square cross-section of each mandrel 3, 4.

In accordance with an essential feature of the present invention, the shape of each mandrel 3, 4 is selected in such a way that a coil 5 can be lifted from the mandrel 3, 4 by means of a hook 6 of the hook-type conveyor 7 without a further contact between the rolled stock and the mandrel. This facilitates the transfer of the coil from the mandrel 3, 4 to the hook and significantly reduces the formation of dust in the form of scale and metal abrasion and, thus, an interruption of the operation of the coil forming station due to failure is prevented.

In accordance with a further development of the present invention, a device is provided with means 22 for placing a cap 21 on a mandrel 3, 4 which is in the vertical position and for removing the cap 21.

In accordance with another feature of the present invention, the wire coil forming station is composed essentially of a rotary table 8 forming the shaft 2 with table surfaces 9, 10 extending at an angle of 90° relative to each other, wherein the table surfaces 9, 10 support the base plates 30, 31 of the mandrels 3, 4.

Figure 2:
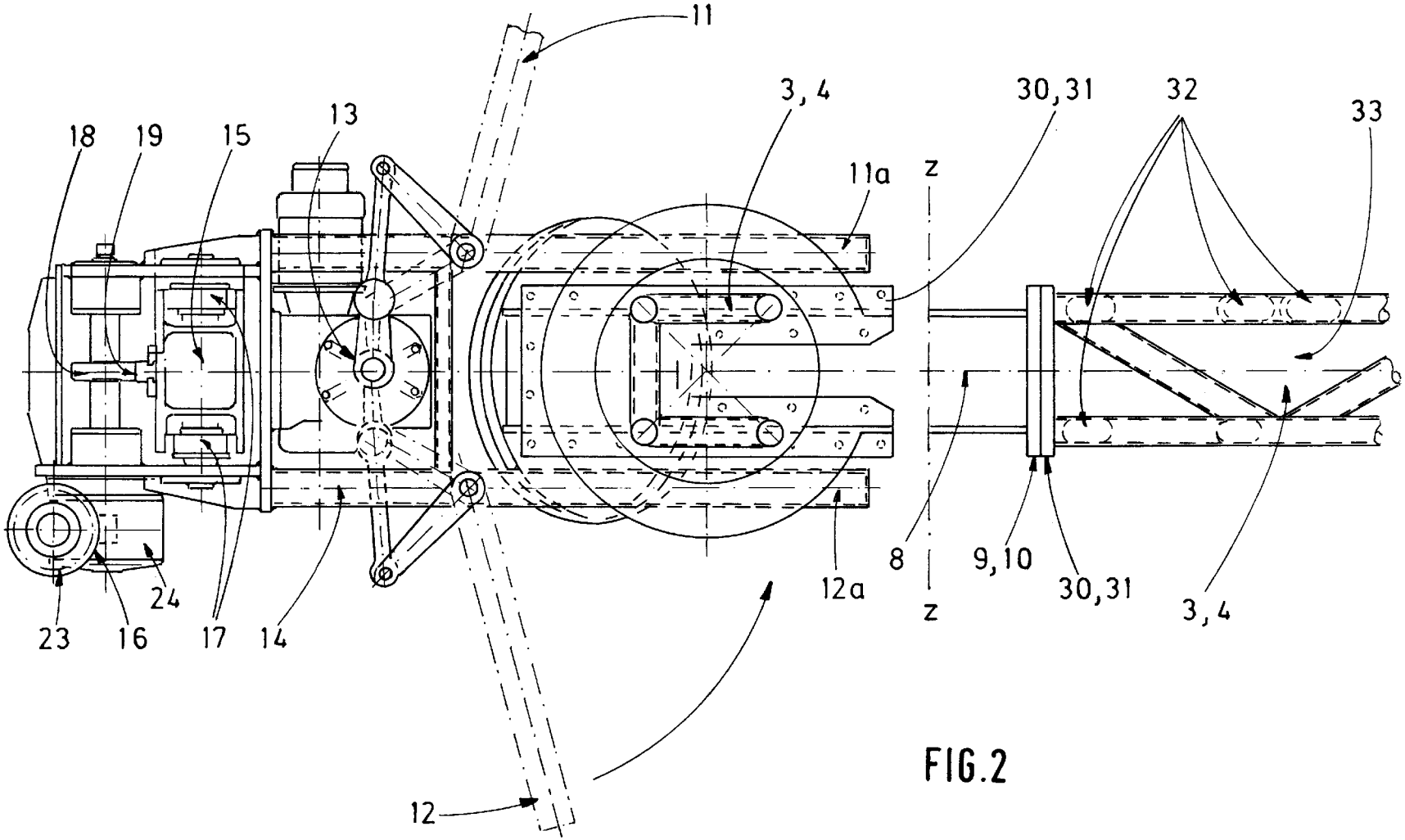
FIG. 2 is a top view of the coil forming station of FIG. 1.

As illustrated in FIG. 2 of the drawing, the mandrels 3, 4 are preferably lattice masts 33 made of pipes 32. At their free ends, the lattice masts 33 are open. This light-weight construction of the lattice masts 33 is uncomplicated, inexpensive to produce and extremely stable at the time. Since the lattice masts 33 are open at their free ends, a hook 6 of the hook-type conveyor 7 can be moved into the lattice masts 33 and can easily lift the load of a coil 5 when being raised within the upwardly open U-shaped section of the lattice masts 33. This makes it possible that the coil 5 can be lifted off from the mandrel 3, 4 without further contact of the rolled material with the mandrel. This saves energy on the one hand, and wear of interacting elements is prevented, on the other hand.

FIG. 2 particularly shows the construction of the mandrels 3, 4 as lattice masts 33 made of pipes 32. The lattice masts 33 have base plates 30, 31, wherein the base plates 30, 31 are tightly connected by means of screw connections to the plates of the rotary table 8 which form the table surfaces 9, 10.

FIG. 2 further shows the coil plate halves 11, 12 pivotally mounted in a guide frame 14 and a pivoting drive for the coil plate halves 11, 12 which may be constructed as a double crank drive 13. The top view of FIG. 2 further shows the cross-section of a guide column 15 which is composed of two I-beams which are connected to each other at their flanges, wherein the rollers 17 of the guide frame 14 are guided in the outer flanges of the I-beams. The drive for moving the frame 14 in vertical direction is effected by means of meshing teeth of a gear wheel 18 in the drive shaft 19 by means of the motor 23 through the worm gear unit 24. Reference numerals 11*a* and 12*a* identify the folded-in positions of the coil plate halves 11, 12 after they have been folded in by means of the double crank drive 13.

FIG. 2 shows on the left hand side of the plane z-z in a top view the mandrels 3, 4 in vertical position. Also visible in a top view are the base plates 30, 31 having the shape of an open U-section, while they are shown in a side view on the right hand side of the plane z-z in the horizontally folded position.

The present invention further provides that the drive 16 includes a control unit, not shown, for adjusting the travel speed of the coil plate halves 11, 12 in vertical direction to the coil forming speed.

In addition, in accordance with an advantageous feature of the present invention, the wire coil forming station may include a device for detecting the coil height during the longitudinal travel movement of the hook 6 for taking up a coil while the detecting device simultaneously also ensures an adjustment of the travel speed of the hook 6 into the coil 5 to the rolling output of the wire train.

The hook 6 of a power-and-free unit is loaded and transferred from the travel rail 7 shown in FIG. 1 to a travel unit with lifting system and is moved into the center of the coil. By determining the height of the coil during the longitudinal travel movement of the hook 6, it is ensured that the wire coil 5 is transported concentrically on the hook 6. It is of decisive importance in this connection that the travel speed of the hook 6 into the wire coil 5 is adjusted to the rolling output of the wire train.

The device according to the present invention is uncomplicated and avoids the above-mentioned disadvantages of the prior art because of the simple and useful construction. Accordingly, the present invention meets the above-mentioned object in an optimum manner.

While specific embodiments of the invention have been shown and described in detail to illustrate the inventive principles, it will be understood that the invention may be embodied otherwise without departing from such principles.

I claim:

1. A wire coil forming station adapted to be arranged following a coiler with cooling line, the wire coil forming station comprising a rotatable shaft having a shaft axis having an inclination of 45° relative to a horizontal base, mandrels mounted at equal circumferential distances at an angle of 45° relative to the shaft axis on a free end of the shaft, the shaft being rotatable for moving each mandrel successively into an approximately vertical coil forming position and into an approximately horizontal position for effecting a transfer of a coil to a longitudinally moveable and raisable and lowerable hook of a hook-type conveyor, each mandrel having an approximately square cross-section and comprising a U-shaped section which has an open free end and is open toward the shaft axis such that the hook of the hook-type conveyor can freely move into the mandrel, said station further comprising a cap for forming a wire coil, the free end of each mandrel comprising a support, for the cap configured to be placed on the support, wherein a diameter of a body of the cap determining a wire coil diameter protrudes with a radial distance to all sides beyond the square cross-section of the mandrel, such that the wire coil formed by the cap protrudes with a radial distance to all sides beyond the square cross-section of the mandrel and that lifting of the coil from the mandrel by means of the hook of the hook-type conveyor is effected without further contact of the coil with the mandrel.

2. The wire coil forming station according to claim 1, further comprising means for placing the cap on and for removing the cap from each mandrel in the vertical coil forming position thereof.

3. The wire coil forming station according to claim 1, wherein the shaft comprises a rotary table with table surfaces extending at an angle of 90° relative to each other, and wherein the mandrels comprise base plates supported by the table surfaces.

4. The wire coil forming station according to claim 1, wherein each mandrel is comprised of pipes forming lattice masts, wherein the lattice masts have open free ends.

5. The wire coil forming station according to claim 1, wherein each mandrel comprises a coil plate, each coil plate having two pivotable halves, further comprising means for opening and closing the coil plate.

6. The wire coil forming station according to claim 5, wherein the means for opening and closing the coil plate is a double crank drive.

7. The wire coil forming station according to claim 5, wherein the means for opening and closing the coil plate comprises moving cylinders.

8. The wire coil forming station according to claim 5, comprising a guide frame, wherein the coil plate halves are mounted in the guide frame, the guide frame including the coil plate halves being guided and vertically moveable by a drive on a guide column extending parallel to and at a distance from a vertical axis of the coil forming station.

9. The coil forming station according to claim 8, further comprising rollers for guiding the guide frame on the guide column, the drive being in engagement with a drive shaft at the guide column.

10. The wire coil forming station according to claim 9, comprising gear wheels for engagement of the drive with the drive shaft.

11. The wire coil forming station according to claim 8, further comprising a control device for adjusting a travel speed of the coil plate halves to a coil forming speed.

* * * * *